US005632055A

United States Patent [19]

Graf

[11] Patent Number: 5,632,055

[45] Date of Patent: May 27, 1997

[54] INFLATABLE OBJECT, IN PARTICULAR AN AIR MATTRESS, COMPRISING A SECTION SERVING AS A PUMP AND A SECTION TO BE INFLATED BY THE PUMP

[76] Inventor: Josef Graf, Sagberg 1, D-83112, Frasdorf, Germany

[21] Appl. No.: 379,540

[22] PCT Filed: Jul. 6, 1993

[86] PCT No.: PCT/EP93/01748

§ 371 Date: Jan. 31, 1995

§ 102(e) Date: Jan. 31, 1995

[87] PCT Pub. No.: WO94/03089

PCT Pub. Date: Feb. 17, 1994

[30] Foreign Application Priority Data

| | | | |
|---|---|---|---|
| Aug. 4, 1992 | [DE] | Germany | 9210427 U |
| Sep. 16, 1992 | [DE] | Germany | 9212489 U |
| Jun. 15, 1993 | [DE] | Germany | 9308870 U |

[51] Int. Cl.[6] ..... A47C 27/08

[52] U.S. Cl. ..... 5/706; 5/708; 5/709; 5/712

[58] Field of Search ..... 5/449, 450, 454; 36/43, 44, 3 B, 3 R; 417/313

[56] References Cited

U.S. PATENT DOCUMENTS

| | | | |
|---|---|---|---|
| 2,686,006 | 8/1954 | Hasselquist | 5/454 |
| 3,042,941 | 7/1962 | Marcus | 5/454 |
| 3,068,494 | 12/1962 | Pinkwater | 5/454 |
| 3,133,696 | 5/1964 | Mirando | 5/454 |
| 4,371,322 | 2/1983 | Lorraine | 417/313 |
| 4,521,166 | 6/1985 | Phillips | 5/454 |
| 4,674,206 | 6/1987 | Lyden | 36/43 |
| 4,930,174 | 6/1990 | Hunter | 5/454 |

*Primary Examiner*—Steven N. Meyers
*Assistant Examiner*—Fredrick Conley
*Attorney, Agent, or Firm*—Jordan and Hamburg

[57] ABSTRACT

An inflatable object, especially an air mattress, with a part acting as a pump and a part inflatable thereby. In the pump part there is a device for spreading its walls making it unnecessary initially to provide air via the user's mouth or a bellows. A particulate propellant material, which may also take the form of waste, is used. A propellant material is a material which can be compressed and which on decompression, with the introduction of air, increases its volume. To prevent propellant material particles from penetrating into the valve between the pump and the inflatable parts, an air-permeable wall is fitted in front of the valve.

28 Claims, 8 Drawing Sheets

3,4
1'
1a
19
2'
2'
29
20
2'
21,22

19',20'
25
23'

23
24
19,20

26
28
27

28
26
26
27

31
32
29
32
30
31
30

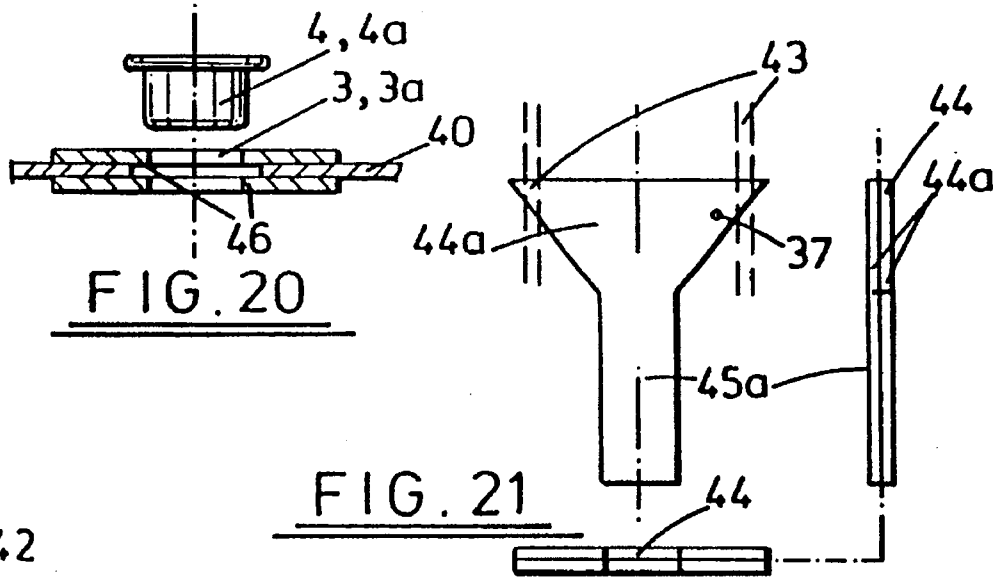
FIG. 20
FIG. 21
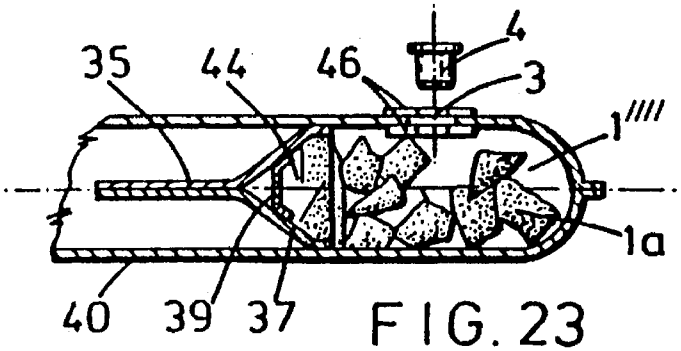
FIG. 23
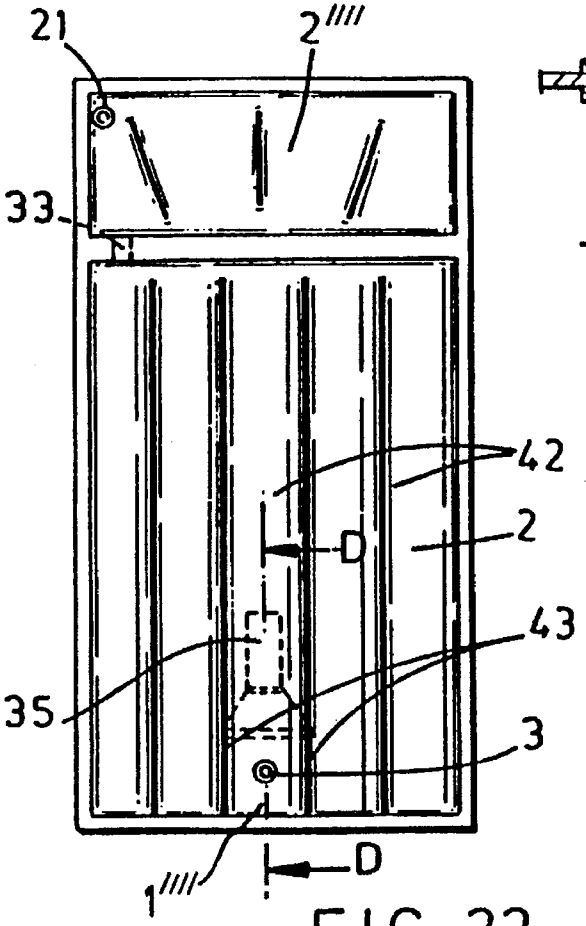
FIG. 22

INFLATABLE OBJECT, IN PARTICULAR AN AIR MATTRESS, COMPRISING A SECTION SERVING AS A PUMP AND A SECTION TO BE INFLATED BY THE PUMP

BACKGROUND OF THE INVENTION

The invention relates to an inflatable object, in particular an air mattress.

An air mattress of this type is known from U.S. Pat. No. 3,155,991. This air mattress has within the inflatable section an independent pump section which is opened by a spring. This pump section terminates at one end in a diaphragm valve, and a small opening in the wall surrounding the diaphragm valve facilitates equalization of pressure. A one-way inlet valve is provided for the entry of air into the pump section. This embodiment does not require inflation of the pump section by mouth or by an external bellows. However, this embodiment is structurally rather elaborate.

An air mattress of similar arrangement is known from U.S. Pat. No. 3,042,941. In this known air mattress, the head section serves as the pump section and comprises a self-spreading formed body which ensures that after compression during the pumping action, the pump section is again pushed open and air can again enter via a one-way inlet valve. In the wall, which is arranged between the pump section and the section to be inflated, is placed a diaphragm valve without flowback facility. In another form of the embodiment, this diaphragm valve is replaced by a permanently open flow-through channel of considerably smaller diameter relative to the one-way inlet valve. This is to ensure that the pressure between the section to be inflated and the pump section is equalized.

In both cases, the element which affects the spreading of the walls of the pump section has to be entered prior to sealing of the pump section, which is cumbersome from a manufacturing point of view. Furthermore, the user of these known air mattresses can feel the element which spreads the wall in the form of a noticeable resistance, which is possibly also optically visible, and is also undesirable. Furthermore, rolling the air mattress is impeded by the shaped spreading bodies.

An air mattress with an integrated pump is known from EP 0 078 763. The head section of this mattress forms a sealed pump container, the dimensions of which are defined by inflatable chambers. The pump container is connected to the lying section of the mattress via a non-return valve. By pressing the head section together, which can be done by the foot of the user, air is conveyed into the lying section. However, the head section cannot be subjected to internal pressure, its hardness is instead determined by the inflatable chambers. In addition thereto, it is necessary to initially inflate the chambers by mouth or by means of a bellows. A desirable even pressure in the head section and in the lying section is usually not achievable.

SUMMARY OF THE INVENTION

It is an object of the invention to provide an inflatable object having a simplified structure, in particular with respect to its manufacture, and especially with respect to the structure of the pump section.

According to the invention there is provided an inflatable object, in particular an air mattress, comprising a section serving as a pump and a section to be inflated by the pump, with the following features:

a) the pump section (1) accommodates a device for spreading apart the walls of the pump section;

b) an inlet opening (3) arranged in the pump section is sealed by a plug (4);

c) between the pump section (1) and the inflatable section (2) is arranged a one-way outlet valve which freely passes air from the pump section (1);

d) a special device permits a small flowback of air in the opposite direction from the inflatable section (2) into the pump section (1);

e) in the inflatable section (2) is arranged an outlet opening (21) which is sealed by a plug (22); characterised by the following features:

f) in the pump section (1) is placed small particle propellant material (1*a*), also in the form of waste;

g) in front of the one-way outlet valve is arranged an air-permeable wall (39).

The use of small particle propellant material, also in the form of waste, makes it possible for the propellant to be entered into the pump section only after manufacture of the inflatable object, i.e. through the inlet opening. However, it is a disadvantage of using waste that the one-way outlet valve gets possibly blocked by said waste, even if it is open celled, which can impede the passage of air. For this reason, an air-permeable wall is arranged in front of the one-way outlet valve, which ensures that the propellant cannot reach the one-way outlet valve.

Propellant material is understood to mean a material which is compressible whilst increasing its volume on decompression and with the addition of air. Examples of a propellant material of this type include open cell propellant material, synthetic wool, plush filler and the like.

When a portion of the head section is used as a pump section, it is particularly economical if one of the web walls, which are in many cases provided in inflatable head sections and which interconnect opposite encasements, is arranged as a separating wall between the pump section and the inflatable section. This separating wall is then to be provided with an extension which by way of folding forms the one-way outlet valve in the form of a diaphragm valve which intrudes into the inflatable section. The pump section is separated from the inflatable section by a separating wall which is placed between opposite walls of the object, which means that the pump section is primarily formed by the walls of the object. This also applies if the pump section is a part of several tubes which form the lying section of a mattress.

A small opening, which is preferably provided either in the part of the diaphragm valve which intrudes into the inflatable section or in the separating wall itself, will then ensure a small flowback of air.

It is particularly advantageous if an opening in the encasement of the pump section serves as an inlet. This opening can be closed by the foot of the user who is inflating the object, thus establishing a sort of one-way valve. For this purpose, the opening is preferably arranged on the top of the pump section.

The invention will now be described in more detail, based on exemplary embodiments illustrated in the drawings. The exemplary embodiments relate to the design of air mattresses. However, it is also possible to apply the invention to inflatable objects of all kinds, wherever an even pressure in both the pump section and in the inflatable section is required. These objects are, for example, inflatable toy figures, islands or the like.

BRIEF DESCRIPTION OF THE DRAWINGS

The drawing illustrates in

FIG. 20: a cross-section through the inlet opening with the perforated plates which are connected to the encasement:

FIG. 21: three views of the foil elements provided for forming a separating wall and a diaphragm valve:

FIG. 22: a top view of an air mattress having a portion of the tubes serving as the lying section arranged as a pump section;

FIG. 23: a cross-section along line D—D in FIG. 22 through the transition from the pump section to the inflatable section.

DETAILED DESCRIPTION OF THE INVENTION

Figure 1:
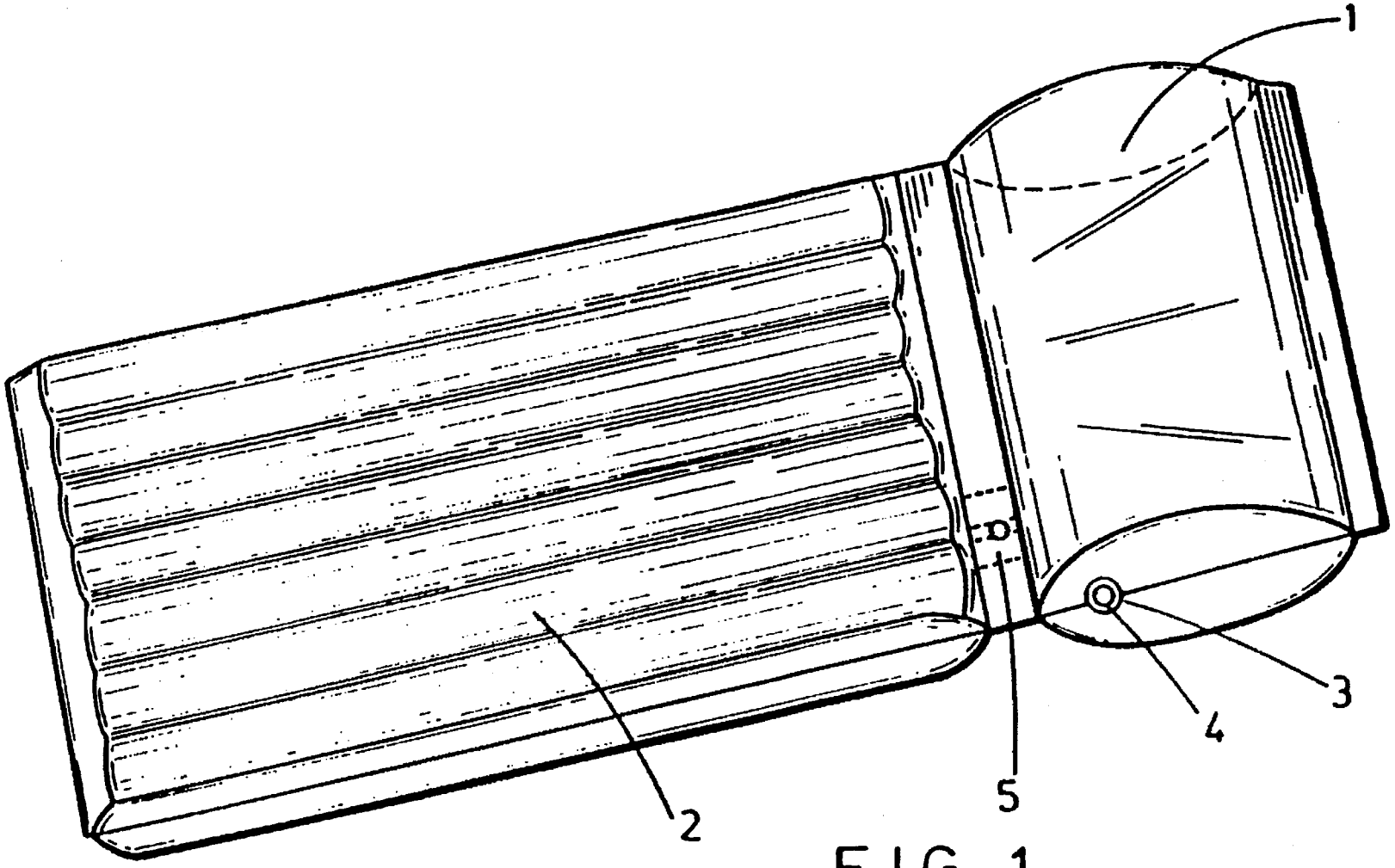
FIG. 1: a perspective view of an air mattress according to the invention.

FIG. 1 illustrates an air mattress having a conventional basic shape. It comprises a head section and a lying section represents. The head section represents the pump section 1, and the lying section the inflatable section 2.

The pump section 1 has a lateral inlet opening 3 which is sealed by an externally fitted plug 4. The plug 4 can be of any conventional type, for example, with a thread or with a seating. All it has to do is prevent the passage of air through the inlet opening 3.

Between the pump section 1 and the inflatable section 2 is accommodated a valve block 5 which, in the exemplary embodiment, is arranged in the strip which separates these sections from one another in an airtight manner.

Figures 13, 14, 15, 16:
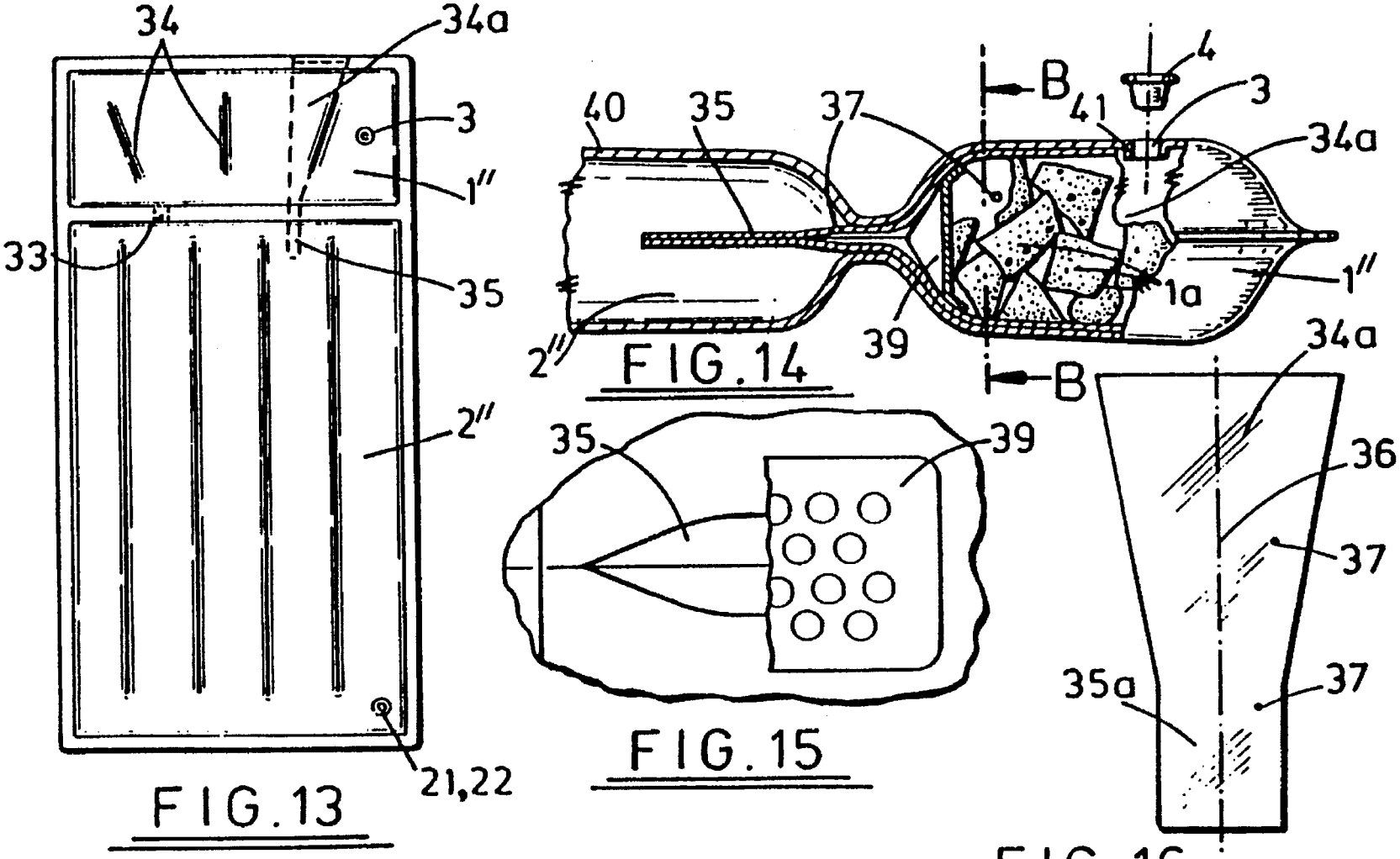
FIG. 13: a top view of an air mattress, where the pump section is a part of the head section.
FIG. 14: a cross-section through the transition from the pump section and inflatable section with a diaphragm valve.
FIG. 15: a cross-sectional view along the line 5—B in FIG. 14.
FIG. 16: a top view of an unfolded separating wall prior to insertion into an air mattress.

The pump section 1 accommodates a propellant material 1*a* (illustrated in FIG. 14). Propellant material is understood to mean a material which increases its volume on entry of air. A preferred propellant material is an open cell synthetic foam material which can also be placed in the head section in the form of waste. A material of this type will expand after compression on entry of air.

In FIGS. 2 to 5 is illustrated the control valve which is fitted between the head section and lying section.

Figure 2:
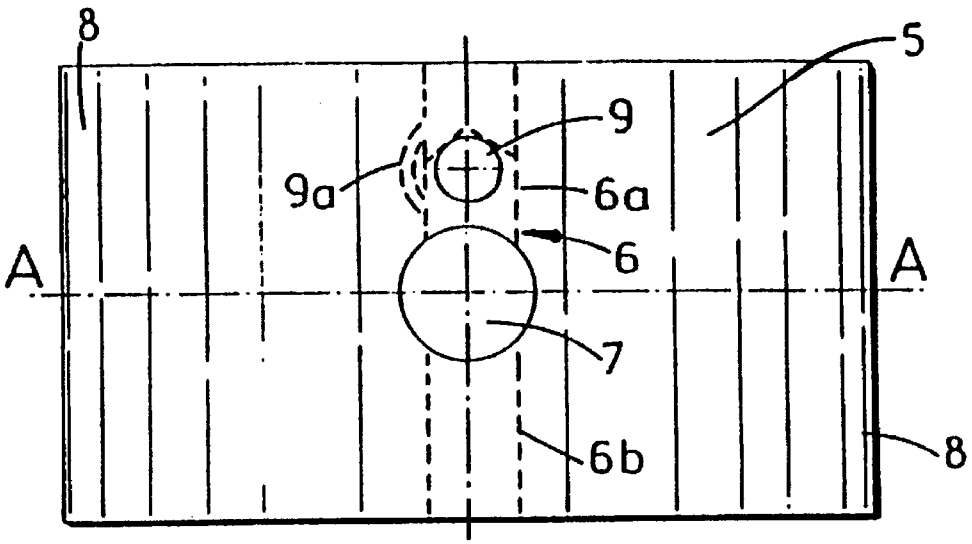
FIG. 2: a top view of a valve block to be arranged between the pump section and the inflatable section.
Figure 3:
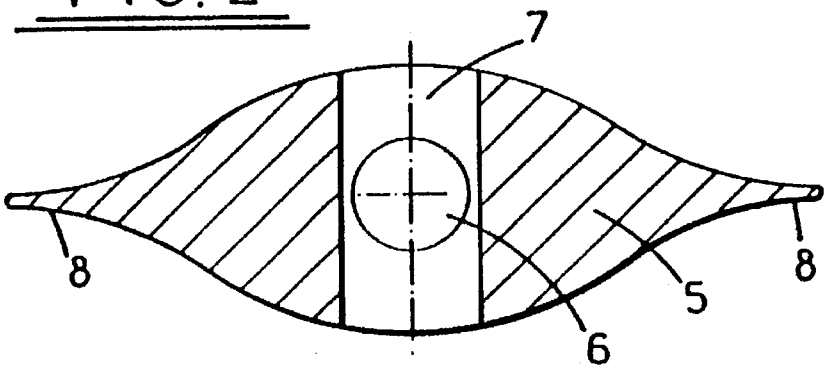
FIG. 3: a cross-section through the valve block along the line A—A in FIG. 2.

The valve block 5 illustrated in a top view in FIG. 2 is substantially of rectangular shape. The valve block 5 has a channel 6 which connects the inner area of pump section 1 with the inner area of the inflatable section 2. Transversely to this channel is provided a bore 7 by which the channel 6 is divided into a section 6*a* which is oriented towards the pump section and a section 6*b* which is oriented towards the inflatable section. The diameter of the bore 7 is larger than that of channel 6 and is continuous in the exemplary embodiment. As is revealed in the cross-section of FIG. 3, the valve block 5 is flattened from the thickest center region at least in the longitudinal direction of the air mattress to form thin wings 8, which makes it easier to accommodate the valve block between the foils which are glued together in the transitional area between the head section and lying section.

In the section 6*a* of the channel 6 which is oriented towards the pump section 1 is arranged a one-way valve 9 of conventional and known structure. It is a feature of this one-way valve 9 that air forced out of the head section by pressing the latter down is allowed to freely pass. However, valve 9 co-acts with a device 9*a* which permits a backflow of a small volume of air in the opposite direction. The backflow can be achieved by deliberate exploitation of a leakage in the one-way valve 9. Alternatively the valve body seal, foe example arranged in the form of flaps, can be provided with a small opening. Finally, it is also possible to bypass the one-way valve 9 by a permanently open bypass having a small cross-section. A bypass of this type 9*a* is purely schematically illustrated in FIG. 2.

Figure 4:
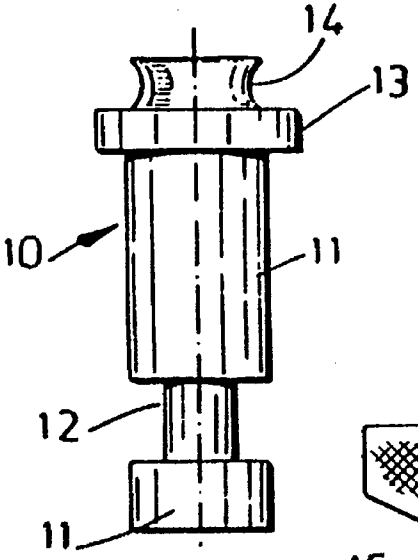
FIG. 4: a side view of the valve body inserted into the valve block, of FIG. 2.
Figure 5:
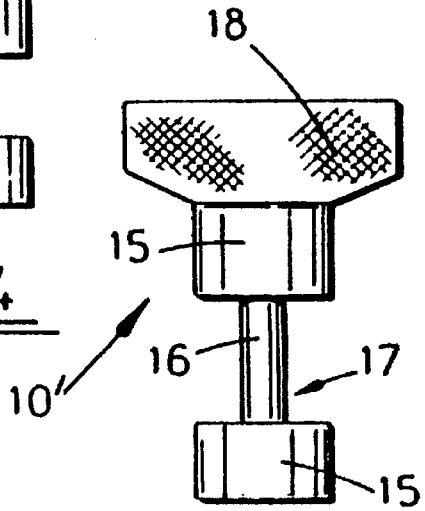
FIG. 5: a side view of another embodiment of the valve body.

The bore 7 accommodates of a valve body 10, 10', as illustrated in FIGS. 4 and 5 in two alternate embodiments.

FIG. 4 illustrates a cylinder slide having between cylinder surfaces 11, which corresponds to the dimension of bore 7, an annular groove 12. At the top, the valve body 10 has an annular collar 13, by which the fully inserted valve body 10 is seated against the top of the bore 7. The valve body 10 has at the top of the annular collar 13 a holding groove 14 in order to allow manipulation of the valve body 10. When inserted into the bore 7, the valve body 10 has two positions. In the first position, the annular groove 12 corresponds with the channel 6, in which case the head section 1 is connected to the lying section 2 and the flow channel is sealed from the atmosphere by the cylinder surfaces 11. In the second position, in which the valve body 10 is pushed fully into the bore 7, a seal between both the head section 1 and the lying section 2 and a seal from the atmosphere is achieved by way of the top larger cylinder surface 11.

In place of an axially displaceable valve body, a valve body 10' in the form of a rotary slide as illustrated in FIG. 5 can be used. This valve body 10' also has cylinder surfaces 15. However, a wall 16 remaining from the original cross-section is established between these cylinder surfaces by way of segmented recesses 17 on both sides. The cylinder surfaces 15 of the rotary slide always offer a seal from the atmosphere, whilst a rotation of the valve body 10', which is carried out by way of a handle 18, above to open a passage through the channel 6 is when the wall 16 is in a longitudinal position and closed the passage when the wall 16 is in a transverse position.

Inflation and deflation of the air mattress is carried out in the following manner:

It is assumed that the air mattress is compressed for folding, for example for the purpose of transportation.

By removing plug 4, air can enter the inner area of the pump section 1 through the inlet opening 3. On introduction of air, the propellant material 1*a* accommodated in the pump section 1 increases in volume until the pump section 1 is sufficiently filled with air. The pump section 1 is then compressed, for example by the foot of the user, so that the air is forced via the channel 6, having a open control valve, into the inflatable section 2. This pumping process is repeated until the lying section is slightly more inflated than finally desired. Once the pumping operation is completed, the inlet opening 3 is sealed by the plug 4. A portion of the air flows back, via the device which permits a minimal backflow, into the head section until the pressure is equal in the sealed systems formed by the head section and the lying section. The valve body is then moved into the second position in which it seals channel 6. The mattress is now ready for use.

If it is desirable that the pump section 1 is somewhat less inflated than the inflatable section 2, then the backflow can be interrupted before full equalization of pressure is achieved.

The air mattress is deflated by removing the valve body 10 and air is removed from the air mattress by compressing it or folding it together. Air is conveyed from both sides through the sections 6*a* and 6*b* of channel 6 to the bore 7 and exits via the latter. When the air mattress is sufficiently compressed, the valve body 10 is inserted into the bore 7, and the plug 4 is fitted. This is necessary, as otherwise the pump element 1 would be inflated to an undesirable extent. The air mattress can be folded together in its compressed state. The described cycle can now be repeated.

Figure 6:
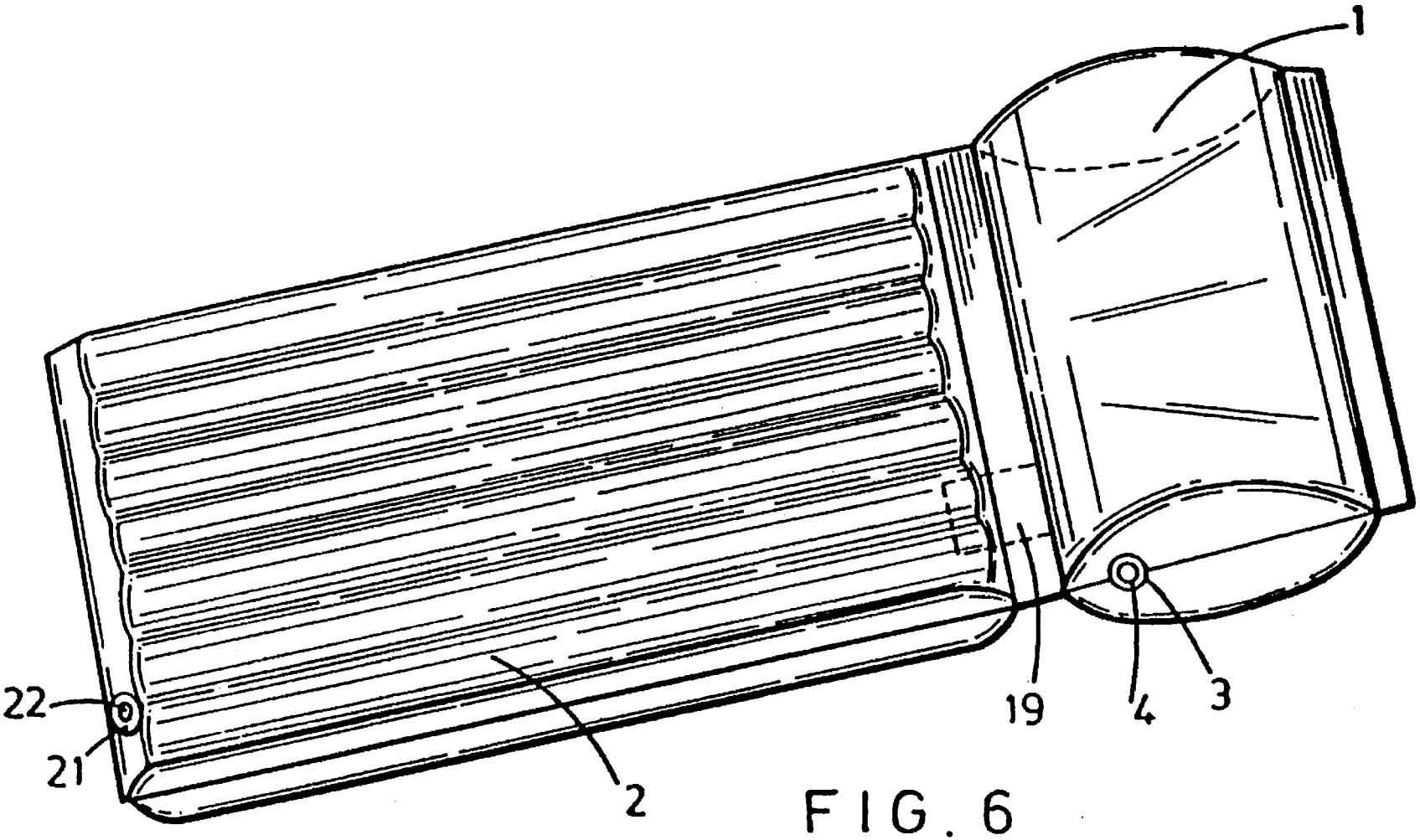
FIG. 6: a perspective view of a two-sectional air mattress, arranged according to the invention and comprising a head section and a lying section, in a modified embodiment.

In FIG. 6 is an air mattress in a basic form corresponding with the object of FIG. 1. It comprises a head section and a lying section. The head section is the pump section 1, and the lying section is the inflatable section 2.

The head section clearly shows the laterally placed afore-described inlet opening 3 which is sealed by an externally fitted plug 4.

Figures 7, 8, 9A, 10, 11, 12:
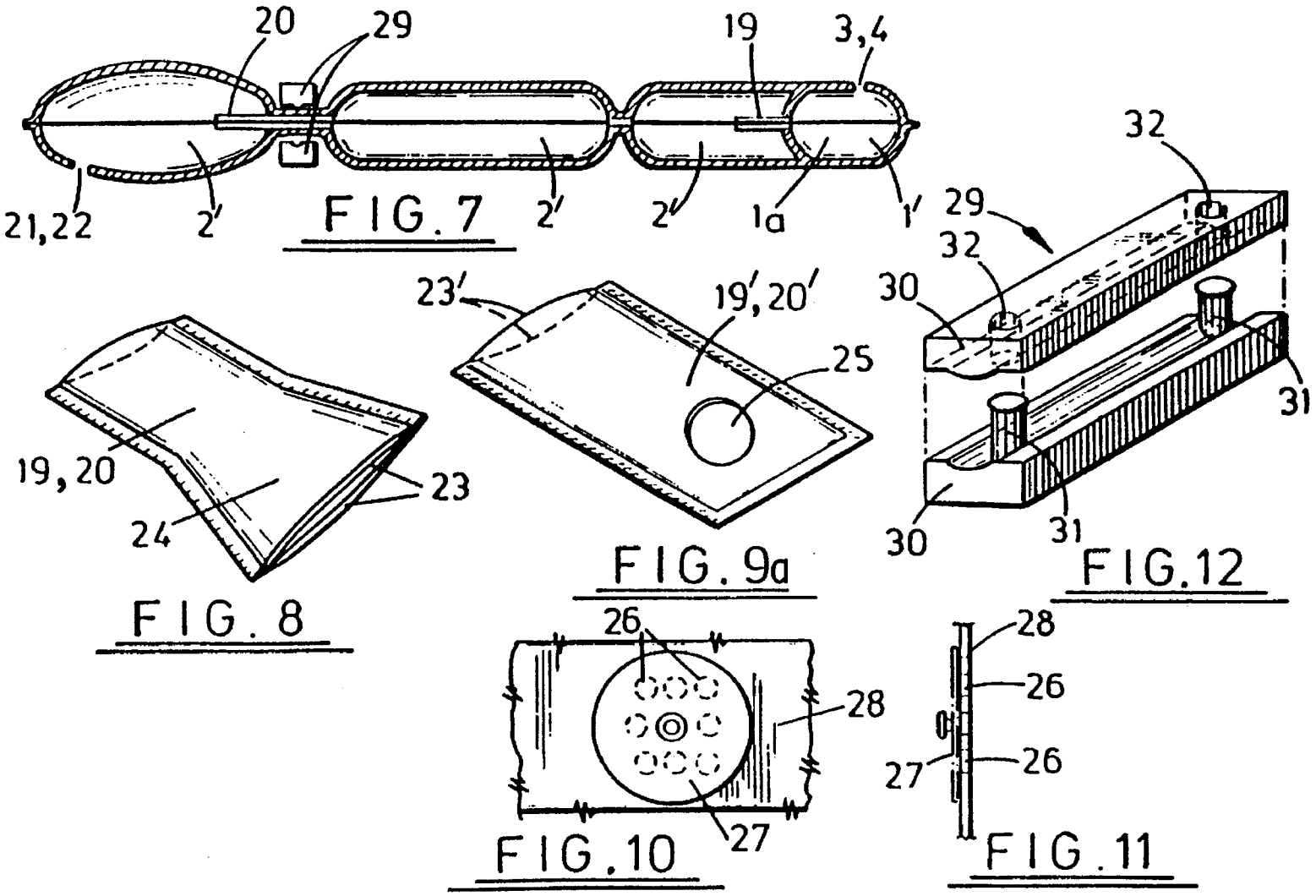
FIG. 7: a longitudinal section through another embodiment of an air mattress arranged according to the invention shown in three sections for erection in a suitable form as a seat.
FIG. 8: a perspective view of a one-way outlet valve or the one-way inlet valve or the one-way valve arranged between the center section and the head section.
FIG. 9*a*: another embodiment of the object shown in FIG. 8.
FIG. 10: a top view of another embodiment of the one-way outlet valve arranged between a pump section and an inflatable section.
FIG. 11: a side view, partially sectional, of the object illustrated in FIG. 10.
FIG. 12: a perspective view of the clamping bar, alternatively illustrated in FIG. 7.

The air mattress illustrated in FIG. 7 is in three sections such that it is suitable for erection as a seat, with the head section being part of the seat. The pump section 11' is arranged in the lower lying section. The propellant material 1*a* is located in the pump element 1'.

The inflatable section 2' of FIG. 7 is composed of a head section, a center section and a portion of the bottom section of the mattress.

Between the pump section 1 and the inflatable section 2 is provided a diaphragm valve 19, which permits free passage of air from the pump section to the inflatable section. However, diaphragm valve 19 only permits a small backflow of air from the inflatable section into the pump section. The ratio of the length of the diaphragm valve to its width is about 1:1.5 to about 1:3.

Figure 9B:
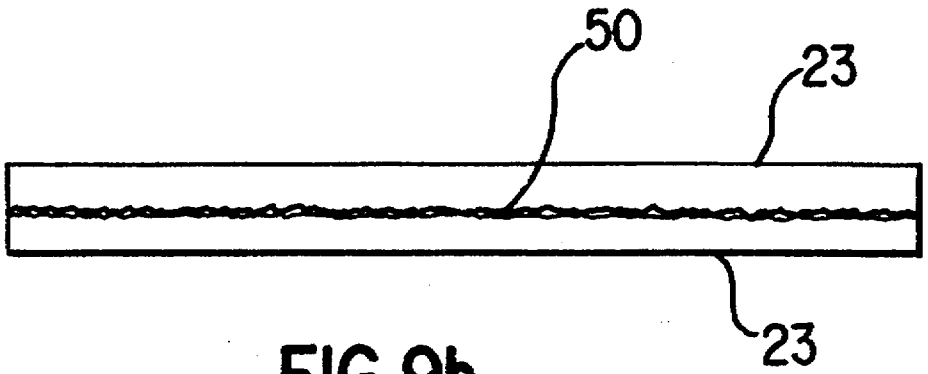
FIG. 9*b*: a cross-sectional view of the one-way outlet valve of either of FIGS. 8 and 9*a;*

For example, the diaphragm valve 19 shown in FIGS. 8 through 9*b* can operate as described above. The diaphragm valve is made of two diaphragm strips 23 or 23' which are interconnected at the edges. These diaphragm strips are rough on the inside surfaces 50, as shown in FIG. 9*b*, so that back flow of air is possible.

According to FIG. 8, the outlet side of the valve is widened in the shape of a cone 24, which prevents this free end, which freely intrudes into the inflatable section 2, from being turned in.

An alternate embodiment of the diaphragm valve of FIG. 8 is illustrated in FIG. 9*a*. In FIG. 9*a* the edges of the diaphragm strips 23' are interconnected on three sides, and an opening 25 in at least one of the diaphragm strips is provided for the escape of air.

Another type of one-way outlet valve is illustrated in FIGS. 10 and 11. A wall 28 of the pump element 1 has perforations 26. These perforations are covered by a thin flexible foil 27. The foil is centrally connected to the wall 28. This valves acts as a one-way outlet valve, because air can move from the pump section 1, which would be to the right of the wall 28 in FIG. 11, through the perforations 26 into the inflatable section whilst lifting the foil 27. On the other hand, the foil 28 covers the holes 26, so that air cannot freely move in the opposite direction from the inflatable section 2 into the pump section, with the exception of intentional leakages.

In FIG. 12 is illustrated a clamping bar 29, which can replace the diaphragm valve 20, clamp 29 is positioned between the center section and the head section of the mattress and is arranged in the same way as the diaphragm valve 19 which is placed between the pump section 1 and the inflatable section 2. This clamping bar comprises two bars 29 which are movable towards one another and have an air passage thereinbetween. The interconnection of the clamping bars 29 is by means of pins 31 which are connected to one of the clamping bars and which engage holes 32 of the other clamping bar. The pins 31 have at their top end an external rim which is deformed when inserted into the holes 32 and which elastically curves towards the outside after passage, so that the interconnection of the clamping bars is ensured. The diaphragm valve 19, the diaphragm valve 20 and a diaphragm valve which seals the inlet opening 3, which can be arranged as in FIGS. 8 through 9*b*, intrude into the adjacent space. Pressure serves to press the diaphragms together. The rough structuring of the diaphragms of diaphragm valve 19 ensures a small flowback of air. The smooth structuring of the diaphragm of diaphragm valve 20 presses them together so that a flowback of air is practically impossible.

Inflation and deflation of the air mattress is carried out in a similar manner as described for FIGS. 1 to 5. However, the mattress is rolled starting from the pump section 1 in the direction of the outlet opening 21 to compress the mattress. Prior to rolling, the plug 22 which seals the outlet opening is removed.

The volume of air flowing back through the diaphragm valve 19 must be smaller than the volume of air entering the pump section 1 via the inlet opening 3.

The inlet sides of the diaphragm valves 19 and 20 are preferably arranged so that the foil strips 23 which form these valves are connected to the edge of the wall of the pump section 1 whilst spreading it apart. This ensures opening of the diaphragm valves which is always necessary for air to pass therethrough.

The air mattress illustrated in a top view in FIG. 13 comprises a head section and a lying section. The pump section 1" is arranged within the head section an inflatable section 2" covers the entire lying section and the larger portion of the head section. These two sections are connected by a passage 33.

In the top side of the pump element 1" is an inlet opening 3 which is sealed by a plug 4.

In the inflatable section 2" is arranged an outlet opening 21 which is also sealed by a plug 22. In the exemplary embodiment, this opening is placed in a corner of the lying section, but it can be located anywhere within the inflatable section.

In the head section are arranged web walls 34 which define the distance between the outer walls of this section.

One of these web walls is arranged to be a separating wall 34*a*, which separates the pump section 1" from the remaining portion of the head section which is to be added to the inflatable section 2". This separating wall 34*a* is provided with an extension 35*a* which establishes, by way of folding along the folding line 36 (FIG. 16), a diaphragm valve 35. In diaphragm valve 35, the free edges are positioned opposite the folding location, are interconnected within the diaphragm valve. The diaphragm valve 35 extends into the inflatable section 2" and is arranged so that its inlet side is opened in the event of positive pressure in the pump section. Particularly economical manufacturing is achieved since the diaphragm valve 35 is practically a part of the separating wall 34*a*.

FIG. 14 shows that the pump section 1" is more or less filled with the propellant material 1*a*. The propellant material is composed of open cell synthetic foam, i.e. in the form of waste, which can be inserted after manufacture of the mattress through the inlet opening into the pump section. Waste materials can be in particular leftovers and/or off-cuts from the synthetic foam material processing industry, but also synthetic wool, plush filler material or the like. It is also feasible to use coloured soft balls, in particular if the inflatable object is transparent.

In front of the diaphragm valve 35 is arranged an air-permeable wall 39 which prevents small particle propellant material from entering the diaphragm valve. This wall 39 has to be dimensioned in such a manner that it does not impede the movements of the pump section whilst also preventing extensive opening of the entry opening of the diaphragm valve in order to prevent the forming of cracks on its lateral welding seams or glue locations.

Inflation and deflation of the air mattress is carried out in a manner similar to the one described earlier.

FIG. 14 reveals that a small opening 37 is arranged either in the separating wall 34*a* or in the part of the diaphragm valve 35 which intrudes into the inflatable section 2", i.e. as close as possible to the seam between pump section 1 and the inflatable section 2". This seam is shown in FIG. 14 as an obvious constriction.

Figure 18:
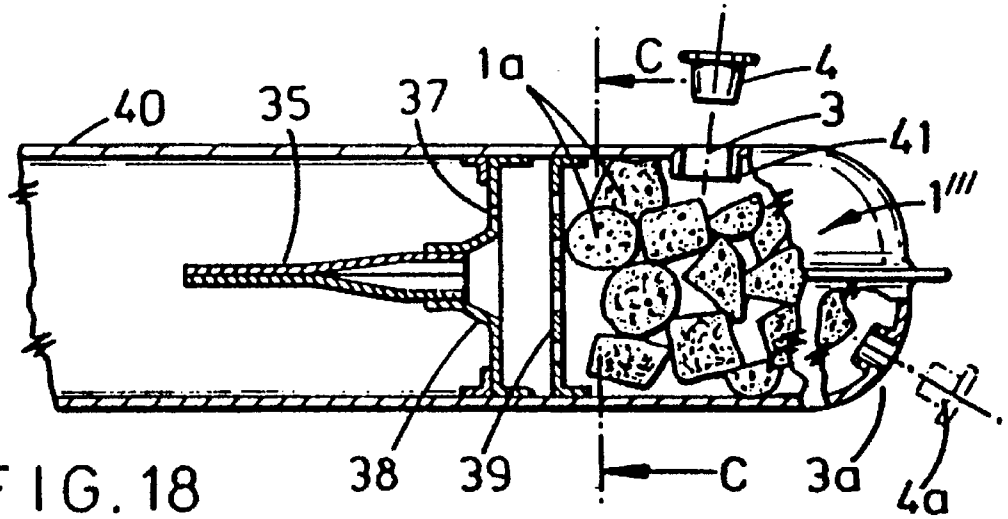
FIG. 18: a cross-section through the transition from the pump section and inflatable section with a diaphragm valve.
Figure 19:
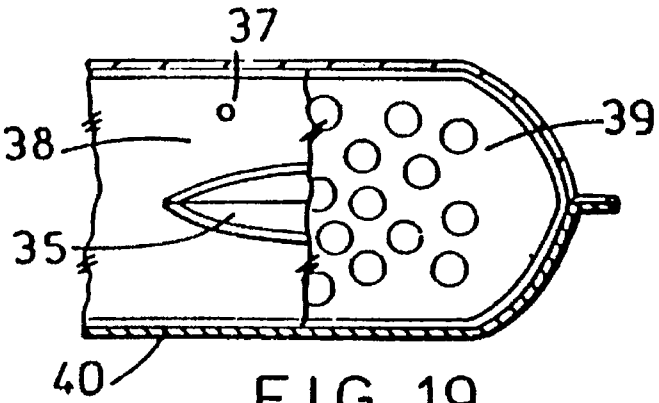
FIG. 19: a cross-sectional view along the line C—C in FIG. 18.
Figure 17:
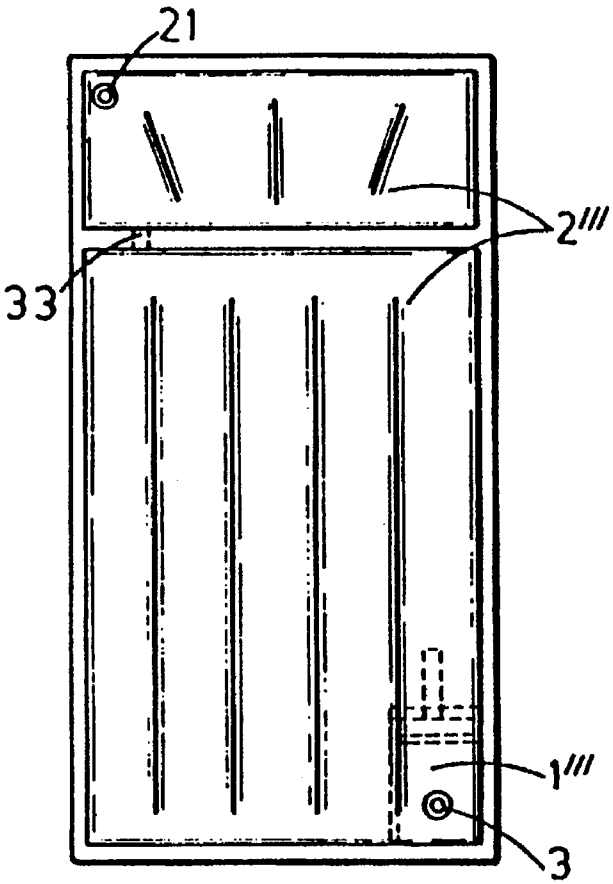
FIG. 17: a top view of an air mattress with the pump section in the lying section of the mattress.

A further exemplary embodiment is illustrated in FIGS. 17 to 19. FIG. 17 shows the pump section 1" arranged at the bottom corner of the lying section. The other section of the mattress represents the inflatable section 2". In the top of the pump element 1" is again provided an inlet opening 3 which is sealable by a plug 4. As in the aforedescribed exemplary embodiments, the pump section 1" is filled by a propellant material 1*a* of the above described composition. In order to prevent propellant material 1*a* from entering the diaphragm valve 35, an air-permeable wall 39 is provided at a distance from the wall 38 into which the diaphragm valve 35 is inserted.

This is carried out in such a manner that the wall is provided with a horizonal slot and the edges defining the slot are bent open towards the inflatable section, and these edges are glued into the foils forming the diaphragm valve 35. In the separating wall 38 is arranged a small opening 37 which ensures a flowback of air.

FIG. 18 illustrates that the inlet opening 3 does not have to be arranged at the top of the pump section 1", but that the inlet opening 3*a* shown in broken lines, which is to be sealed by the plug 4*a*, can also be positioned on another part of the pump section, for example at the side. In this case, it has to be ensured that the cross-section of the inlet opening 3*a* is substantially smaller than the cross-section of the diaphragm valve 35, so that on compression of the pump section the major portion of air flows through the diaphragm valve 35 into the inflatable section 2". It is understood that a certain loss of air through the inlet opening 3*a* is unavoidable. Inflation and deflation of the air mattress is carried out in a manner similar to the ones described earlier for the other exemplary embodiments.

FIG. 20 illustrates that the inlet opening 3 or 3*a* is in the form of one or several perforated plates 46 with a bore diameter slightly smaller than that of the plug and the hole in the encasement 40.

During insertion of the plug 4 or 4*a* into the somewhat narrower edges of the perforated plates, these edges are seated on its flanks, as seen from the direction of insertion of the plug, thus ensuring optimum seal and firm seating of the plug 4.

The outlet opening 21 can be arranged in the same way.

A further very economical embodiment of the pump section 1"" is illustrated in FIGS. 21 to 23. The separating wall 44 comprises two diaphragm portions 44*a* which are interconnected at the edges, in which respect the outer edge of the conically extending broad end must correspond with the entire circumference of the tube 42 which forms the pump element 1"". The outer edge is connected to the peripheral wall of the tube 42. Adjacent to the conical narrowing is the diaphragm valve 35 with extension 45*a*, having an air-permeable wall 39 in front of its inlet opening in order to prevent entry of pieces of propellant material 1*a* into the opening of the diaphragm valve 35. In the separating wall 44 is arranged a small opening 37 which ensures a flowback of air.

FIG. 22 shows that the pump section 1"" is defined in one of the longitudinally arranged tubes 42, which form the lying section of the mattress, by the separating wall 44 and the seams 43 which separate the tubes 42 from one another. Seam 43 is provided on both sides of the pump section 1"" and intersect the lateral corners of the trapezoidally structured part of the foil portions 44*a*. Inflation and deflation of the air mattress is carried out in a similar way as described earlier with other exemplary embodiments.

I claim:

1. An inflatable object comprising:

at least a first inflatable section and a second inflatable section, the first section forming a pump having an inlet for admitting air into the first section for inflating the second section;

the pump including:

a plurality of compressible particles for compression thereof and subsequent decompression with a concomitant increase in volume upon introduction of air through the inlet;

a one-way valve means for communicating air to the second section from the pump in the first section;

an air permeable wall means between the compressible particles and the valve means for preventing the compressible particles in the pump from entering the valve means while permitting air to be communicated from the pump to the second section; and back flow means for communicating air from the second section to the first section upon cessation of pumping to equalize pressure in the first and second sections for inflating the first section.

2. The inflatable object according to claim 1, wherein the second section has an outlet for deflating the inflatable object by permitting air to exit the second section.

3. The inflatable object according to claim 1, wherein a cross-section of the inlet is substantially smaller than a cross-section of said one-way valve means in an open state.

4. The inflatable object according to claim 1, wherein the plurality of compressible particles is at least one material selected from the group consisting of an open cell propellant material, an open cell synthetic foam, synthetic wool and plush filler.

5. The inflatable object according to claim 1, wherein the inlet is sealed by a hose valve, the hose valve comprises two foil strips connected to each other at their respective edges, and the foil strips intrude into the first section.

6. The inflatable object according to claim 1, wherein the inlet comprises an annular opening with an annular groove therein, and the inflatable object further comprises a plug having a flange for engaging the annular groove of the inlet.

7. The inflatable object according to claim 1, wherein the inlet permits air to enter the inflatable object and permits air to exit the inflatable object.

8. The inflatable object according to claim 1, wherein the one-way valve means comprises a diaphragm valve having two foil strips connected to each other at two of their respective edges, and each of the two foil strips has a rough inner surface for permitting the one-way valve to leak to allow back flow for pressure equalization between said first and second sections.

9. The inflatable object according to claim 8, wherein the diaphragm valve has a trapezoidal portion and the widest cross-section thereof is directed towards the second inflatable section.

10. The inflatable object according to claim 1, further comprising a third inflatable section and sealing means for selectively sealing the third inflatable section off from the second inflatable section.

11. The inflatable object according to claim 10, wherein the sealing means comprises a clamping bar having two bars displaceable towards one another.

12. The inflatable object according to claim 1, wherein the one-way valve means comprises a valve block having a channel connecting the first section and the second section, a valve body supported within a bore transversely cut through the channel, the bore within the channel having a greater diameter than a diameter of the channel, the valve body is moved within the bore to a first position permitting connection between the first and second sections of the inflatable object and a second position preventing communication between the first and second sections, and a one-way valve within the channel in communication with the bore, the one-way valve permitting air to be communicated from the first section to the second section when the valve body is in the first position and preventing air from being communicated from the first section to the second section when the valve body is in the second position.

13. The inflatable object according to claim 12, wherein the back flow means is a roughened surface in an interior of the one-way valve.

14. The inflatable object according to claim 12, wherein the one-way valve has a seal for sealing off the first section from the second section, and the back flow means is an aperture in the seal.

15. The inflatable object according to claim 12, wherein the back flow means is a bypass means for bypassing the one-way valve.

16. The inflatable object according to claim 12, wherein the valve body is a cylinder slide having an annular groove.

17. The inflatable object according to claim 12, wherein the valve body is a rotary slide comprising a cylinder having segmented recesses.

18. The inflatable object according to claim 12, wherein a longitudinal cross-section of the valve block tapers from a middle section thereof to either side thereof.

19. The inflatable object according to claim 1, further comprising first separating means for separating the first section from the second, the first separating means having an extension extending in a substantially straight line from the first section into the second section, and the extension of the first separating means comprises the one-way valve means.

20. The inflatable object according to claim 19, wherein the back flow means is an aperture in the one-way valve means.

21. The inflatable object according to claim 19, wherein the back flow means is an aperture in the first separating means.

22. The inflatable object according to claim 19, wherein the one-way valve means is a diaphragm valve and the ratio of the length of the diaphragm valve to its width is about 1:15 to about 1:3.

23. The inflatable object according to claim 1, further comprising a second separating means between the air permeable wall means and the second section for separating the first section from the second section, and the second separating means being attached to the one-way valve means.

24. The inflatable object according to claim 23, wherein the one-way valve means is welded to the second separating means.

25. The inflatable object according to claim 23, wherein the second section includes at least one seam separating means for incompletely separating the second section into a plurality of sections freely communicating the air between them within the second section, the first section is in one of the plurality of sections of the second section, the air permeable wall means is between the plurality of compressible particles and the second separating means, and the second separating means terminates in the one-way valve means in an end of the second separating means opposite the air permeable means.

26. The inflatable object according to claim 25, wherein a portion of the second separating means is trapezoidal and a base thereof faces the pump, and the base has corners intersecting at least two seam separating means.

27. The inflatable object according to claim 23, wherein the back flow means is an aperture in the second separating means.

28. The inflatable object according to claim 23, wherein the one-way valve means is a diaphragm valve and the ratio of the length of the diaphragm valve to its width is about 1:1.5 to about 1:3.

* * * * *